US005887877A

United States Patent [19]

Nero

[11] Patent Number: 5,887,877

[45] Date of Patent: Mar. 30, 1999

[54] IN-LINE ROLLER SKATES

[76] Inventor: Lu T. Nero, 638 Country Path Dr., New Castle, Del. 19720

[21] Appl. No.: 911,768

[22] Filed: Aug. 15, 1997

[51] Int. Cl.[6] ..... A63C 1/28

[52] U.S. Cl. ..... 280/11.22; 280/11.31

[58] Field of Search ..... 280/11.22, 11.23, 280/1.27, 11.3, 11.31, 809, 816, 842, 624, 625, 11.36, 615; 36/117.1, 132

[56] References Cited

U.S. PATENT DOCUMENTS

| | | | |
|---|---|---|---|
| 3,829,111 | 8/1974 | Nicholls | 280/11.3 |
| 3,963,252 | 6/1976 | Carlson | 280/11.22 |
| 4,004,823 | 1/1977 | Pyzel et al. | 280/615 |
| 4,613,150 | 9/1986 | Cooper | 280/615 |
| 4,708,352 | 11/1987 | Vullierme | 280/11.26 |
| 4,872,272 | 10/1989 | Wittmann et al. | 36/117 |
| 5,092,614 | 3/1992 | Malewicz | 280/11.22 |
| 5,199,726 | 4/1993 | Willett | 280/11.27 |
| 5,224,718 | 7/1993 | Gertler | 280/11.19 |
| 5,277,437 | 1/1994 | Moats | 280/11.23 |
| 5,286,043 | 2/1994 | Tkaczyk | 280/11.22 |
| 5,295,701 | 3/1994 | Reiber et al. | 280/11.22 |
| 5,314,199 | 5/1994 | Olson et al. | 280/7.13 |
| 5,393,077 | 2/1995 | Wanous | 280/11.22 |
| 5,397,141 | 3/1995 | Hoshizaki et al. | 280/11.3 |
| 5,421,596 | 6/1995 | Lee | 280/11.19 |
| 5,470,085 | 11/1995 | Meibock et al. | 280/11.2 |
| 5,494,304 | 2/1996 | Levy et al. | 280/11.2 |
| 5,507,506 | 4/1996 | Shadroui | 280/11.22 |
| 5,615,901 | 4/1997 | Piotrowski | 280/11.3 |
| 5,741,018 | 4/1998 | Huang | 280/11.3 |

*Primary Examiner*—Lanna Mai
*Assistant Examiner*—Avraham H. Lerner
*Attorney, Agent, or Firm*—Jeffrey C. Lew

[57] ABSTRACT

An in-line roller skate has a wheel assembly that is easily removable from and re-attachable to a boot. The boot can be attached by simply stepping into wheel assembly and buckling a strap.

2 Claims, 6 Drawing Sheets

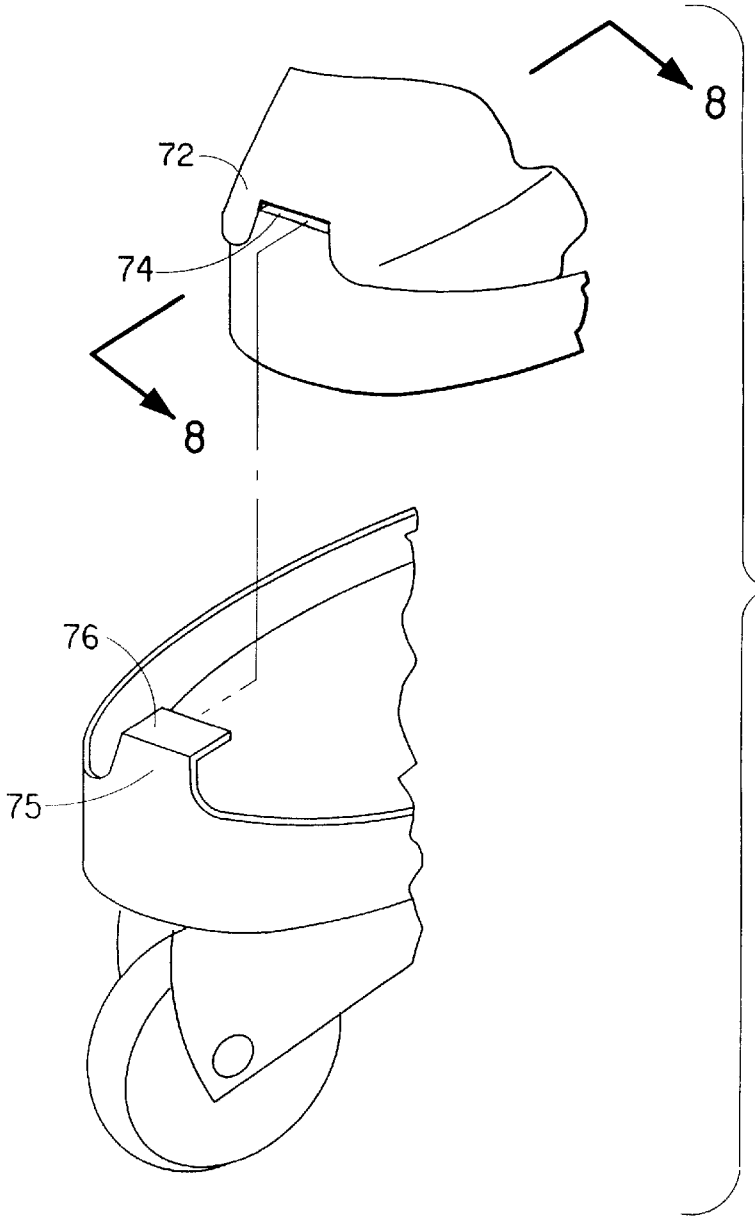
FIG.7
FIG.8
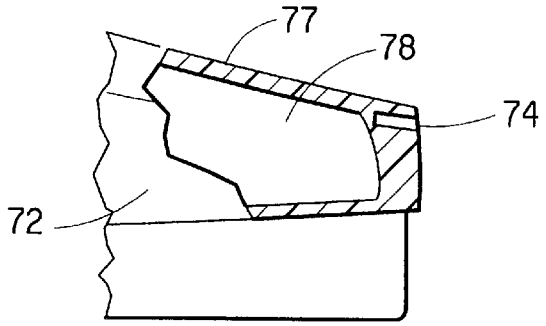

IN-LINE ROLLER SKATES

FIELD OF THE INVENTION

This invention relates to in-line roller skates, and more specifically, to an in-line roller skate with an easily removable wheel assembly.

BACKGROUND AND SUMMARY OF THE INVENTION

Roller skating generally and especially in-line roller skating have been practical and recreational activities for quite some time. Due largely to technological advances which provide ever lighter, stronger, quieter and faster skates, in-line roller skating recently has become an increasingly popular sport.

A modern in-line roller skate typically includes a boot with a wheel assembly permanently affixed to the sole. Wheels are rotatably mounted to the assembly with axles in conventional manner. The skater inserts a foot into the boot and fastens the boot firmly to the foot with a fastening means such as laces or straps.

Permanent attachment of the wheel assembly to the boot presents a major inconvenience to the modern in-line skate user. When the skater arrives at a destination such as inside a building, or encounters an unpaved road surface, the skater may wish to stop skating and begin walking. A skater using a skate with a permanently attached wheel assembly must remove the whole skate from the foot. Furthermore, the skater must carry shoes to the destination to use after removing the skates.

U.S. Pat. No. 5,314,199 discloses convertible in-line roller skates that include a skate assembly which permits rapidly interchanging and reversing ice blades and in-line rollers. Each skate includes a shoe having a sole plate and toe and heel attachment pads secured to the plate, with a surface blade coupling means provided in a recessed zone of the toe and heel attachment. Among other things, the skate also has a blade support assembly with a frame having rollers or ice blades attached to the bottom thereof. The frame includes toe and heel pad receiving cavities designed to firmly receive and retain the attachment pads in releasable manner. A skater using the disclosed convertible in-line roller skates would not be able to walk around after removing the frame from the skate assembly because the attachment pads protrude downward from the sole plate toward the walking surface. Thus the bottom of the shoe has an uneven surface which makes walking difficult. Furthermore, walking could wear excessively and destroy the attachment pads. Thus the patented roller skates do not solve the problem mentioned above.

U.S. Pat. No. 5,507,506 of Shadroui describes a roller boot quick release/attach mechanism which allows the wheels to be quickly and easily removed from the boot portion of an in-line skate. The boot contains slide channels built into the boot sole and heel. The wheel frame contains slide rails and a lock/release lever to provide attachment and locking of the wheel frame to the boot. Shadroui's quick release/attach mechanism permits the skater to dismount from wheel portion and to walk in the boot portion of the skate. Nevertheless, it is still desirable to provide an improved in-line roller skate with an easily removable/reattachable boot for walking and a strong mechanism for connecting the boot and wheel assembly.

A strong connection mechanism is desirable to give the skater superior control in high performance skating maneuvers such as safely negotiating sharp turns at high speed and skating on and over obstacles such as curbs, steps and uneven pavement. Such a new in-line roller skate with quickly detachable wheel assembly is disclosed herein. The boot can be attached by simply stepping into the wheel assembly and buckling a strap. Moreover, when attached the boot and wheel assembly are very firmly connected, thus providing excellent transmission of force between the skater's foot and the wheels.

Accordingly, the present invention provides an in-line roller skate comprising:

(a) a boot having a sole, a toe section and a heel section; the boot being undercut upwards from the sole to define a shoulder along at least the heel section;

(b) a wheel assembly having a head plate with a forward portion, wherein the wheel assembly is releasably attachable to the boot;

(c) an upwardly directed flange attached to the head plate and adapted to engage the shoulder of the boot;

(d) a strap means attached to the wheel assembly for releasably fastening the sole firmly to the head plate; and (e) gripping means for releasably engaging the toe section to a forward portion of the head plate.

BRIEF DESCRIPTION OF THE DRAWINGS

FIG. 7 is a partial exploded perspective view of a different embodiment of the novel in-line skate.

FIG. 8 is a section view of the toe section of the boot of the embodiment shown in FIG. 7.

DETAILED DESCRIPTION

Figure 1:
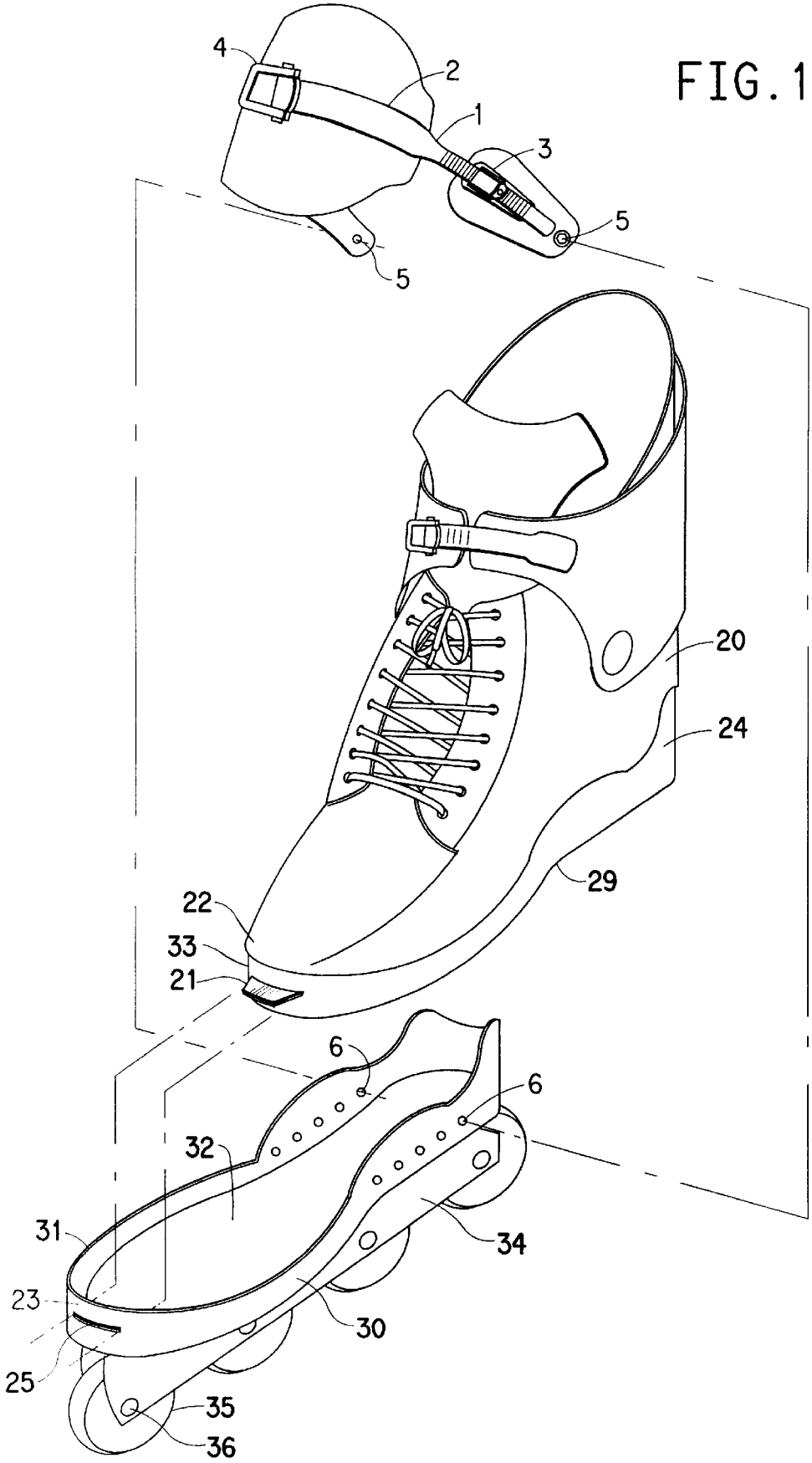
FIG. 1 is an exploded perspective view of one embodiment of the novel skate.

The present invention encompasses the combination of a boot and wheel assembly which fit together to form an in-line roller skate. The boot can be installed in the wheel assembly quickly and easily. Just as easily the wheel assembly can be detached as a unit from the boot with the skater's foot remaining inside. This enables the skater to immediately begin walking on paved or unpaved terrain while wearing the boot.

It is important that the boot fits into the wheel assembly snugly with close tolerances, and preferably a friction fit. Also, the structurally supportive portions of both pieces should be constructed of rugged, and generally, non-yielding materials, such as metal, engineering polymer and/or structural composites, including fiber reinforced plastic, for example. This preference for structurally strong and dimensionally stable materials applies more to the sole and sole perimeter portions of the boot than the upper portions near the ankle and instep which can be made of more resilient material for purposes of comfort while skating or walking. The structurally strong and tight-fitting nature of the wheel assembly and the lower portions of the boot will cause these separate pieces to act very much like an integrally manufactured unit when properly fit together. Consequently, the skater will be able to precisely transmit force from the feet to the wheels. This will accord the skater excellent control at high speed and to safely carry out intricate skating maneuvers. Structural reinforcement of the lower portions of the boot will also retard wear of the boot sole when the boot is used as a shoe for walking.

The basic elements of the novel in-line roller skate can be best understood by reference to FIGS. 1–6 which depict a preferred embodiment of the invention. The skate 10 includes a boot 20 and a wheel assembly 30. The boot has a forwardly disposed toe section 22 and rearwardly disposed heel section 24. The upper portion of the boot is similar to conventional sport equipment boots such as ski boots and in-line skate boots in that it is designed to hold the foot wearing a sock in a firm but comfortable manner. Typically, such sports equipment boots include a rigid outer shell and an interior, foam-filled liner to cushion the foot from the shell. Sometimes openings through the shell for ventilation are provided. Ventilation openings can be incorporated in a skate according to the present invention provided that the holes do not materially interfere with operation of the gripping means and flange-undercut elements described below. The boot also includes means for firmly securing the foot within the boot, such as laces 26 and ratcheted clasp 27 of substantially conventional design and materials. The boot further includes an upper skin 28 of the outer shell and a sole 29 at the bottom.

The wheel assembly 30 generally includes a head plate 32 and a frame subassembly 34 to which freely rotatable wheels 35 on axles 36 are mounted in conventional manner. The frame subassembly is permanently affixed to the bottom of the head plate in rigid fashion by conventional means such as rivets, screws and nutted-bolt fasteners, not shown. The frame subassembly fastening means can extend upward above the top surface of the head plate 32, however, the head plate is intended to mate with the boot. Therefore cavities corresponding to any such upwardly extending parts of the frame subassembly fastening means may be carved out of the boot sole to accept such upwardly extending parts and to provide a stable, tread-like textured ground contact surface for walking.

The sole of the boot is adapted to mate with the head plate of the wheel assembly. The sole 29 and head plate 32 are generally flat. Such flat design provides stability of the boot when used by the skater as a shoe for walking when the wheel assembly is removed from the skate. As mentioned, some irregularity of the sole and head plates can be tolerated. A heavy tread texture as is sometimes incorporated in conventional work boot, hiking boot and sport shoe designs is acceptable. In one aspect, the present invention seeks to provide a boot that is suitable for walking comfortably after removal of the wheel assembly. Accordingly, it is contemplated that the head plate and sole can be contoured to include a heel on the boot and raised arch such as exist in conventional shoes. Of course, the head plate should have the reverse contour of the sole to provide intimate, strong and rigid contact between the boot and wheel assembly when deployed as a skate.

Figure 2:
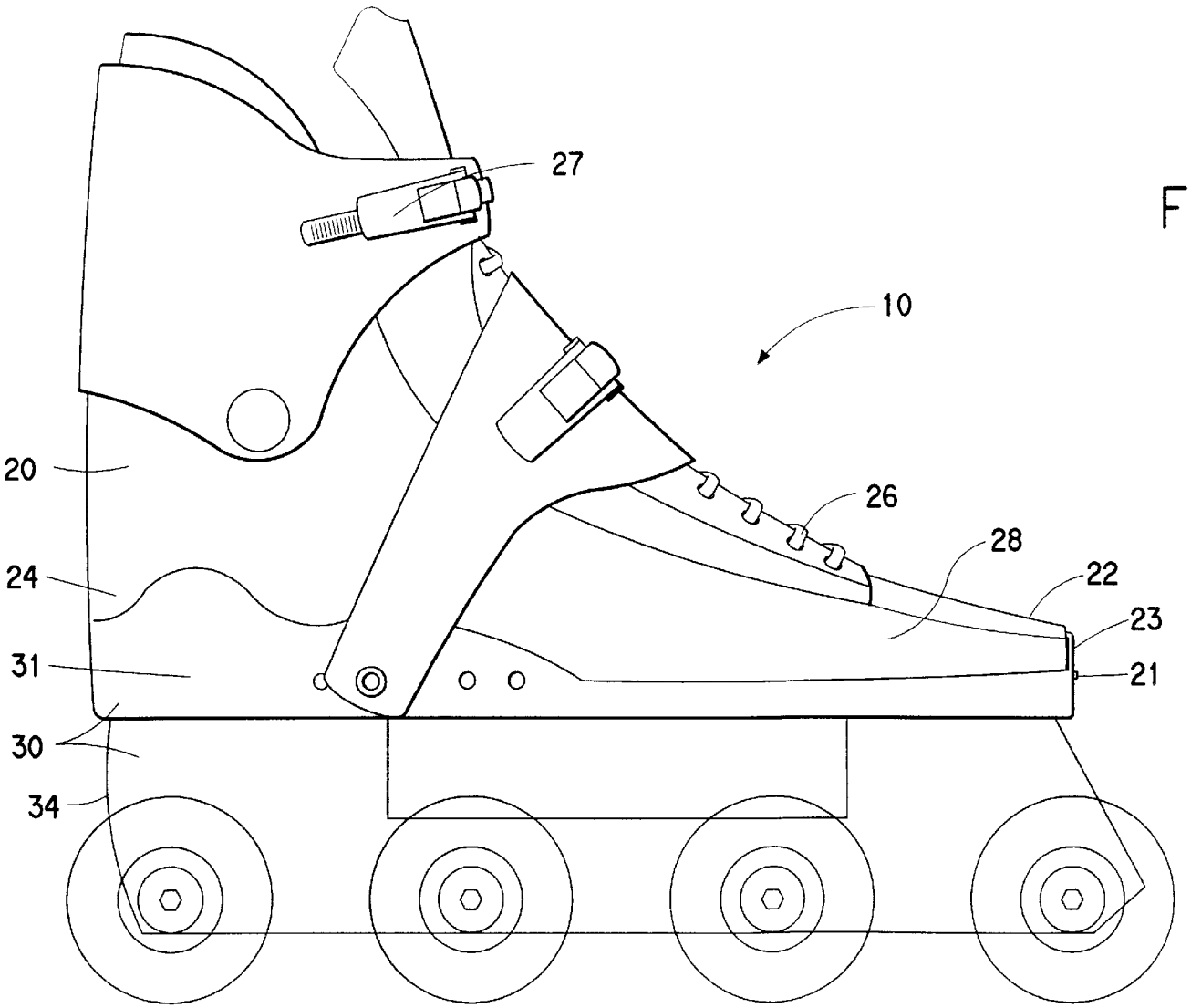
FIG. 2 is a side elevation view of the embodiment of the novel skate shown in FIG. 1.
Figure 4:
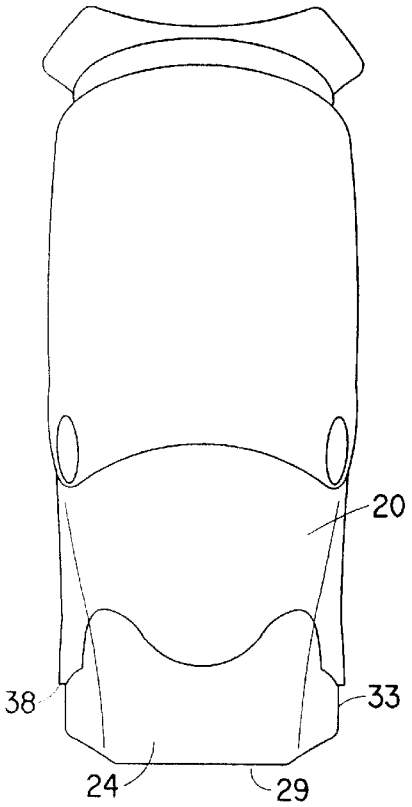
FIG. 4 is a rear elevation view of the boot of FIG. 1.
Figure 3:
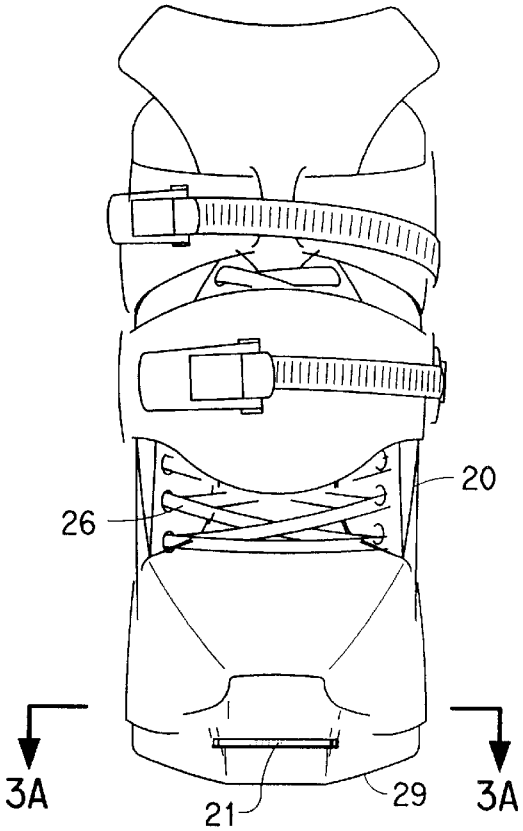
FIG. 3 is a front elevation view of the boot of FIG. 1.
Figure 6:
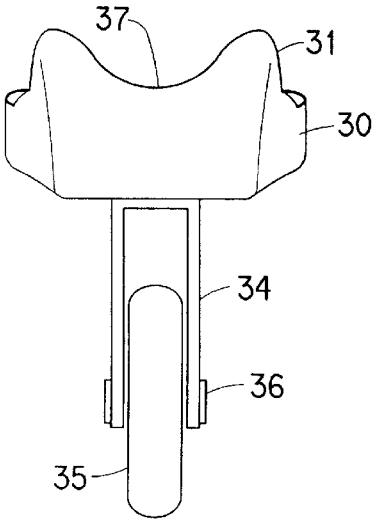
FIG. 6 is a rear elevation view of the wheel assembly of FIG. 1.
Figure 5:
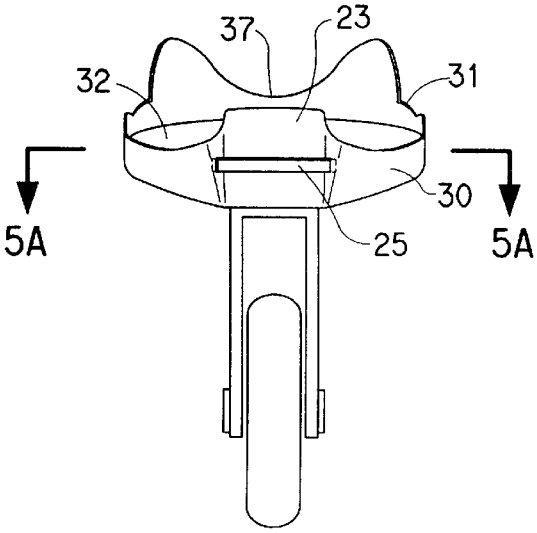
FIG. 5 is a front elevation view of the wheel assembly of FIG. 1.
Figure 3A:
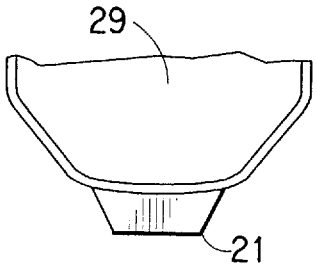
FIG. 3A is a partial plan view taken along line 3A—3A in FIG. 3.
Figure 5A:
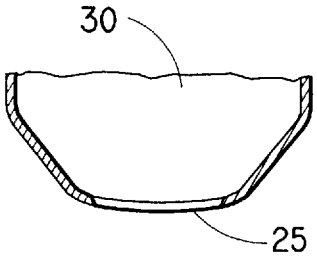
FIG. 5A is a partial plan view taken along line 5A—5A in FIG. 5.
Figure 9:
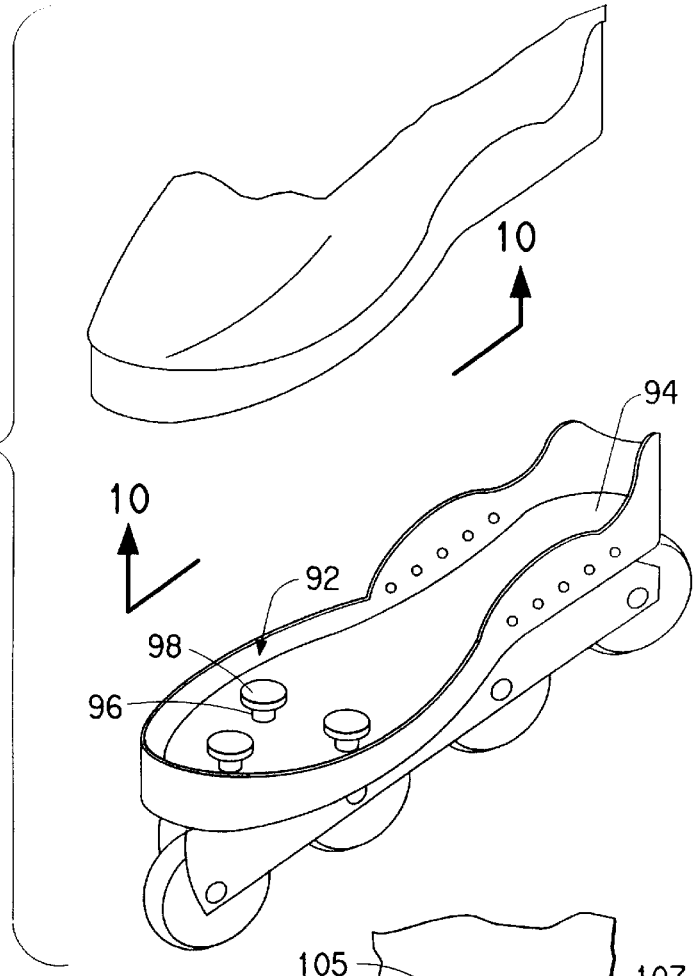
FIG. 9 is a partial exploded perspective view of a another embodiment of the novel in-line skate illustrating pegs useful for firmly securing the sole of the boot to the head plate of the wheel assembly.
Figure 10:
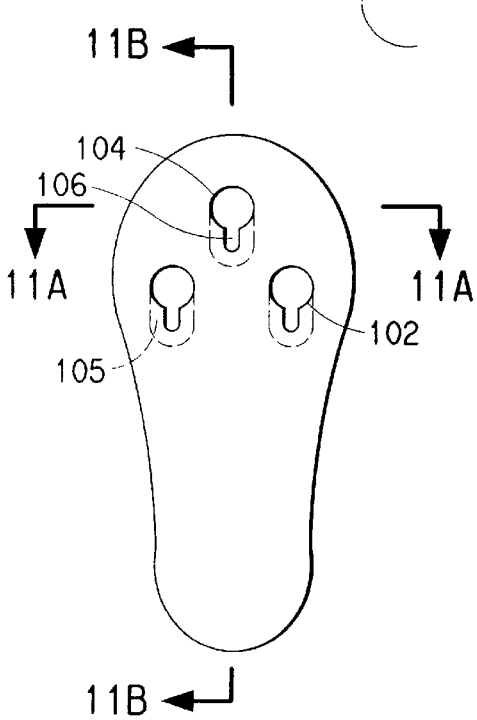
FIG. 10 is a bottom view taken along line 10—10 in FIG. 9.

One defining feature of this invention is that the head plate includes at its outer edge an upwardly directed flange 31. The upper skin of the boot further has a complementary peripheral undercut 33 extending from the sole to a variable height. The undercut defines a shoulder 38. The flange is designed to engage the peripheral undercut to a close tolerance with the shoulder resting on the top of the flange when the boot is attached to the wheel assembly. The engagement between flange and indentation thus provides improved lateral stability between boot and wheel assembly. The flange should at least extend around the rear portion of the head plate but can optionally extend completely along the circumference as shown in FIGS. 1–6. The minimum height of the flange is selected to provide the desired lateral stability. For the most part, the flange height should be at least about 0.6 cm. Preferably, the flange height will be greatest at the heel section, and especially at the sides of the heel. The flange height can be reduced 37 between the heel sides. This feature helps the skater to remove the boot from the wheel assembly. That is, after unbuckling strap means 1 the skater desiring to disengage the wheel assembly need lift the heel only slightly to clear the reduced height flange 37 then pull the boot rearward. The undercut is sculpted or molded from the outer skin of the boot. Preferably, the depth of the undercut should equal the width of the upwardly directed flange. Thus, the boot and wheel assembly when deployed together as a skate will present a smooth vertical profile as best seen in FIG. 2. The outer dimension of the lower portion of the boot should be oversized relative to the size of the foot in comparison to a normal shoe to allow for that portion of the skin which is removed to create the peripheral undercut.

A second defining feature of the present invention is a gripping means provided to releasably attach the forward parts of the boot and wheel assembly. FIGS. 1–6 illustrate an embodiment in which the gripping means comprises an outwardly extending horizontal protrusion 21 at the toe section of the boot and a corresponding frontal flange 23 of the wheel assembly cut through to define a horizontal slit 25. The size and shape of the slit is selected to receive the outwardly extending horizontal protrusion to a close tolerance. This will maintain the toe section of the boot in fixed position relative to the wheel assembly. The horizontal protrusion optionally can include a taper to narrow cross section forward from large cross section aft, and the slit can be furnished with a corresponding taper adapted to mate with the tapered protrusion. This tapering effect allows the skater to easily slip the protrusion into the slit when installing the wheel assembly onto the boot. Although only one horizontal protrusion and slit are shown in the illustrated embodiment, the present invention contemplates variations such as multiple protrusions of different shapes. The common aspect among these variations is that the protrusion element of the gripping means engages the slit element at the toe section of the boot in an easily detachable manner.

A third defining feature of the novel in-line roller skate is a strap means 1 for releasably locking the sole of the boot firmly to the head plate of the wheel assembly. The strap means can be of conventional design such as laces, belt and buckle, or ratcheted clasps similar to that used to maintain the foot within the boot. Generally, the strap means comprises a cross-instep band 2 that is affixed permanently to at least one side and can be releasably secured to the other side of the wheel assembly. For example, the anchor mechanism 3 and lock mechanism 4 can be attached with pins 5 inserted through selected holes 6 of the upwardly directed flange. Multiple holes are optionally provided to give the user choice of selection for optimum fit and comfort. Moreover, if the flange wears away through aggressive use so as to break the flange defining one set of holes, another set of holes can be used.

The design of the closure portion of the strap means is not particularly critical. Preference is given to many of the existing types of clasps known in the art of roller skating and snow skiing. These clasps typically include a flexible, robust plastic serrated belt that can be easily adjusted to proper length and tensioned with a meshing lever attached to the side of the strap means of the wheel assembly opposite belt attachment side. In another contemplated embodiment, not shown, the strap means can include two separate tension clamps disposed on opposite sides of the foot, one portion of each clamp being attached to the wheel assembly and a second portion being attached to the boot below the ankle in position to mate and releasably secure the other portion. In the latter embodiment, no strap across the instep is required.

A different embodiment of the novel in-line skate is shown in FIGS. 7 and 8 wherein the gripping means comprises a toe section 72 defining an outwardly facing slot 74 and a wheel assembly with an inwardly extending tab 76 on the upwardly directed flange 75. The slot and tab shapes are selected for the slot to receive the tab and to allow the tab to slidingly engage the slot within a close tolerance. The slot and tab can taper from a large cross section at the mouth of the slot to a narrow cross section at the base of the slot. Such tapering facilitates installing the boot on the wheel assembly and can provide for a pressure fit between these two units to hold the toe section very firmly in fixed position relative to the head plate. FIG. 8 shows that the slot can be machined or molded from a built up region at the toe section. The slot optionally can be placed elsewhere on the toe section. For example, the skin 77 above the toe cavity 78 can be built up to a thickness sufficient for placing the slot above the toes. In another contemplated variation, the slot can be formed in a thickened portion of the sole under the toes. In still another variation, the slot can take the form of an open channel on the outer surface of the upper skin above the toes. In each case, the size and shape of the tab is chosen to mate with the slot.

In another preferred embodiment shown in FIGS. 9, 10, 11A and 11B, the novel in-line roller skate can include a plurality of mushroom-shaped pegs 92 extending upward from the top surface of the head plate 94. The pegs have a narrow stem 96 and a broad cap 98. The precise shape of stem and cap is not critical, although the cap should be dimensionally larger than the stem. A cylindrical stem and circular cap are preferred. Also in this embodiment, the sole defines a plurality of openings 102 disposed above the pegs and adapted to mate therewith. Each opening includes a wide bore 104 extending upward into the sole to a distance effective to receive the cap and stem of a corresponding peg. As can best be seen in FIG. 11A, extending rearwardly from this wide bore is a channel 106 defined by walls 108 of the boot sole 109. Interior to the sole and above the channel and shoulders is a recess 105. The recess is of a size effective to receive the broad cap of the corresponding peg. The position of the pegs on the head plate is not critical. Preferably groups of pegs should be placed in positions below the ball of the foot.

Figure 11A:
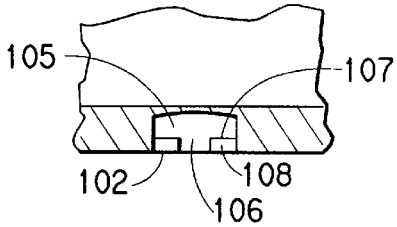
FIG. 11A is a section view taken along line 11A—11A in FIG. 10.
Figure 11B:
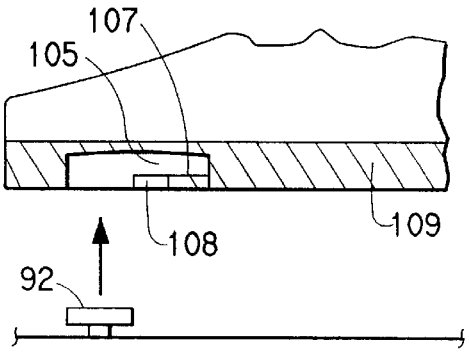
FIG. 11B is a section view taken along line 11B—11B in FIG. 10.

The pegs and bores serve to hold the sole tightly against the head plate. In use the skater dons the boot and laces it securely to the foot. Next the boot is positioned over the head plate with the broad caps directly under the wide bores. The boot is lowered onto the head plate so that the bores receive the broad caps of the pegs, as shown in FIG. 11B. The height of the stem is chosen such that the underside of the cap will be in a friction fit with the top surface 107 of shoulder 108 as the skater moves the boot forward on the wheel assembly. This motion drives the peg rearward in the recess. The heel is lowered in place of confinement by the upwardly directed flange engaging the peripheral undercut of the boot. Finally, strap means is closed to secure the boot firmly to the wheel assembly. To remove the wheel assembly for walking in the boot, this procedure is reversed.

The other preferred embodiments of the novel in-line skate are operated similarly. That is, the toe of the boot is aligned with the forward section of the wheel assembly to insert the tab or protrusion into slot or slit, respectively. Then the heel of the boot is lowered onto the wheel assembly and the strap means fastened.

Although specific forms of the invention have been selected for illustration in the drawings, and the preceding description is drawn in specific terms for the purpose of describing these forms of the invention, this description is not intended to limit the scope of the invention which is defined in the claims.

I claim:

1. An in-line roller skate comprising:

(a) a boot having a sole, a toe section and a heel section; the boot being undercut upwards from the sole to define a shoulder along at least the heel section;

(b) a wheel assembly having a head plate with a forward portion, wherein the wheel assembly is releasably attachable to the boot;

(c) an upwardly directed flange attached to the head plate and adapted to engage the shoulder of the boot;

(d) a strap means attached to the wheel assembly for releasably fastening the sole firmly to the head plate; and (e) gripping means for releasably engaging the toe section to a forward portion of the head plate, the gripping means comprising at least one outwardly extending horizontal protrusion on the toe section and a frontal flange extending upward from a forward portion of the head plate, the frontal flange defining at least one horizontal slit adapted to receive the outwardly extending horizontal protrusion;

wherein the shoulder and upwardly directed flange extend completely along the circumference of the skate.

2. The invention of claim 1 wherein the protrusion tapers from narrow cross section forward to large cross section aft and the slit has a corresponding taper adapted to mate with the tapered protrusion.

* * * * *